US008230787B2

(12) United States Patent
Flemming et al.

(10) Patent No.: US 8,230,787 B2
(45) Date of Patent: Jul. 31, 2012

(54) METHOD FOR ADJUSTING AN AREA COVERAGE AND A CORRESPONDING METHOD FOR EXECUTION IN A PRINTING PRESS HAVING A PLURALITY OF PRINTING COUPLES

(75) Inventors: Steven Flemming, Radebeul (DE); Harald Heinrich Willeke, Paderborn (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 13/138,444

(22) PCT Filed: Jan. 26, 2010

(86) PCT No.: PCT/EP2010/050845

§ 371 (c)(1),
(2), (4) Date: Aug. 16, 2011

(87) PCT Pub. No.: WO2010/091947

PCT Pub. Date: Aug. 19, 2010

(65) Prior Publication Data

US 2011/0297027 A1 Dec. 8, 2011

(51) Int. Cl.
*B41F 31/02* (2006.01)
*B41F 33/00* (2006.01)

(52) U.S. Cl. ..... 101/484; 101/365

(58) Field of Classification Search ..... 101/484, 101/365, 350.2, 349.1, DIG. 45, DIG. 47
See application file for complete search history.

(56) References Cited

U.S. PATENT DOCUMENTS

| | | | | |
|---|---|---|---|---|
| 5,010,820 | A | 4/1991 | Loffler | |
| 5,447,102 | A | 9/1995 | Pfeiffer et al. | |
| 6,679,169 | B2 * | 1/2004 | Anweiler et al. | 101/350.1 |
| 7,059,245 | B2 * | 6/2006 | Mayer et al. | 101/365 |
| 7,121,208 | B2 * | 10/2006 | Gateaud et al. | 101/483 |
| 2003/0217660 | A1 * | 11/2003 | Yamamoto et al. | 101/365 |
| 2010/0199867 | A1 | 8/2010 | Kuhlmeyer et al. | |

FOREIGN PATENT DOCUMENTS

| | | | |
|---|---|---|---|
| DE | 37 07 695 | A1 | 9/1988 |
| DE | 43 12 229 | A1 | 10/1994 |
| DE | 10 2008 029 998 | A1 | 1/2009 |
| JP | 11-105255 | | 4/1999 |

* cited by examiner

*Primary Examiner* — Leslie J Evanisko
(74) *Attorney, Agent, or Firm* — Mattingly & Malur, P.C.

(57) ABSTRACT

An area coverage, which is carried out by a volume of printing ink transferred to a print stock by an inking unit of a printing press, can be adjusted. An ink feed to the inking unit can be disengaged in zones or can be interrupted in the inking and upon reaching of a final phase of a printing process which was previously carried out by the printing press. The volume of printing ink remaining on the print stock after such a disengagement or interruption in the ink feed in the inking unit in the final phase of the printing process previously carried out by the printing press, is transferred to the print stock until the area coverage made by the volume of printing ink transferred to the print stock equals a specified target value of area coverage for an impression of a subsequent printing process. A corresponding method is also provided for execution in a printing press that has a plurality of printing units.

21 Claims, 5 Drawing Sheets

METHOD FOR ADJUSTING AN AREA COVERAGE AND A CORRESPONDING METHOD FOR EXECUTION IN A PRINTING PRESS HAVING A PLURALITY OF PRINTING COUPLES

CROSS REFERENCE TO RELATED APPLICATIONS

This application is the U.S. national phase, under 35 U.S.C. 371, of PCT/EP2010/050845, filed Jan. 26, 2010; published as WO 2010/091947 A1 on Aug. 19, 2010; and claiming priority to DE 10 2009 000 877.2, filed Feb. 16, 2009, the disclosures of which are expressly incorporated herein by reference.

FIELD OF THE INVENTION

The invention relates to a method for adjusting an area coverage and to a corresponding method for execution in a printing press comprising a plurality of printing couples.

BACKGROUND OF THE INVENTION

From DE 37 07 695 A1, a method for the defined production of an ink distribution appropriate to a production run in the inking unit of rotary printing presses prior to the start of printing is known, in which first, the values stored in a computer for the zonal adjustment of the dosing elements and the length of the ink strip used for the previous print job are compared with the values, input into a second computer memory, for the zonal adjustment of the ink dosing elements and the length of the ink strip provided for the subsequent print job, and then from the ink zone values, the differential zonal ink quantities are determined, and, supplemented by the zonal quantities stored in the inking unit, are transported by the rotating inking unit back into the ink fountain, or are transported to the inking unit, depending on whether the difference in the quantity of ink is positive or negative, wherein before this occurs, the number of inking unit rotations required until the zonal differences in ink quantities are equalized is determined, and wherein only thereafter are the ink dosing elements and the length of the ink strip that is transferred to the inking unit adjusted as necessary in the inking unit for the subsequent print job, wherein with this adjustment, ink is not transported out of the inking unit or into the inking unit.

From DE 43 12 229 A1, a method for the defined production of an ink distribution appropriate to a production run in the inking unit of rotary printing presses with a change in print job is known, in which, upon completion of a print job, the ductor roller of the inking unit is disengaged, after which impression is thrown on and paper travel is started, and a small number of printed copies are produced, and then paper travel is stopped and impression is thrown off, wherein the rubber blanket is cleaned and the printing plate for the previous print job is replaced by the printing plate for the new print job, wherein the ductor roller is then engaged and the ink feed to the inking unit begins with the impression thrown off, and thereafter, impression is thrown on and paper travel is started for the new print job.

A method for correcting an ink layer thickness is known from JP 11 105255 A. A reduction in the ink layer thickness on inking unit rollers is automatically introduced and implemented once the print run of a current production job is reached, in an operating status in which the ink feed has been ended.

In changing over a printing press, for example, a rotary printing press, preferably a sheet-fed printing press, more particularly, a sheet-fed printing press that prints in an offset printing process, from a first, currently running printing process to a second, subsequent printing process, it is necessary to reset the distribution of an ink to be transferred to a print substrate that will be imprinted in the printing press, which distribution is used along a transport path during the execution of the first printing process, in order to produce a high-quality printed product in the second printing process that is free of any undesirable effects from the printed product produced in the first printing process.

The distribution of this ink used during the execution of the first printing process along the transport path of the ink is generally non-uniform transversely to a direction of transport of the print substrate that is transported through the printing press for the purpose of imprinting, i.e., a plurality of mostly differently pronounced accumulations of the ink that will ultimately be transferred to the print substrate form along an intersecting line that extends transversely to the direction of transport of the print substrate, due to the fact that the print substrate to be imprinted during its transport through the printing press absorbs ink unevenly, transversely to its direction of transport, due to a generally non-uniform configuration of a printed image to be produced on the print substrate.

The transport path of the ink begins from an ink dosing system, which belongs to an inking unit of the printing press, and passes through the inking unit that is supplied with ink by the relevant ink dosing system, via a printing forme disposed on one of the printing couple cylinders belonging to a printing couple of the printing press, for example, and up to the print substrate to be imprinted with the relevant ink. The non-uniform distribution of the ink that is provided by the ink dosing system and is used during the execution of the first printing process along this transport path, transversely to the direction of transport of the print substrate, is present, for example, in the case of a rotary printing press that imprints in an offset printing process, particularly on surfaces of rollers disposed in the inking unit and on the at least one printing forme disposed on a printing couple cylinder embodied as a forme cylinder, and on the outer surface of an additional printing couple cylinder, which is embodied as a transfer cylinder and interacts with the forme cylinder.

In most printing presses, a plurality of printing couples, each having its own inking unit, are provided, and are arranged in a row along the transport path of the print substrate, in the transport direction thereof. At least two of these printing couples transfer different inks to the same print substrate being transported through the printing press. Each of a plurality of printing couples on both sides of the transport path of the print substrate can also be provided with its own inking unit. A printing press for producing a multicolor printed product can imprint the print substrate along the transport path thereof with cyan, magenta, yellow and black colored inks, for example. The inking unit of each printing couple is embodied, for example, as a roller inking unit, such as, for example, as a ductor-type inking unit or as a film inking unit, and wherein these configurations of an inking unit are known to a person skilled in the art. The ink dosing system, such as, for example, an ink fountain, supplies the relevant inking unit with ink and has, for example, an ink fountain roller that is rotatable about its longitudinal axis, and at least one dosing element. Preferably a plurality of zonally adjustable dosing elements are provided transversely to the direction of transport of the print substrate, with each such element being controllable particularly by the use of a correcting element. The dosing elements are embodied, for example, as ink blades arranged spaced from the ink fountain roller at varying distances ranging within a few tenths of a millimeter. At least one ink forme roller belonging to the inking unit transfers the ink, which is supplied by the inking unit, for example, and which, more particularly, is dosed differently to the zones of the ink dosing system that are arranged transversely to the direction of transport of the print substrate, to the at least one printing forme, which is disposed, for example, on the forme cylinder allocated to that inking unit.

As was stated above, in order to change the printing press over from a first printing process, currently running in the printing press, to a subsequent, second printing process, it is necessary to reset the distribution of the ink to be transferred by an inking unit to the print substrate that will be imprinted in the printing press, which distribution is used along the transport path during the execution of the first printing process. Assuming that the relevant inking unit of the printing press will transfer the same ink onto the print substrate in the subsequent, second printing process as it did in the first printing process in each case, the following procedures for implementing the changeover are known in practice:

Upon completion of the first printing process currently running in the printing press, at least individual rollers, preferably all rollers, of the relevant inking unit are cleaned, and thereby freed of residual ink, i.e., ink remaining behind from the first printing process. Following this cleaning process, the relevant inking unit is adjusted to the dosing and the transport of the ink required for executing the subsequent, second printing process. This procedure requires a substantial amount of time and leads to a heavy consumption of ink.

Another procedure consists in disengaging or at least interrupting in the inking unit an ink feed to the inking unit by the relevant ink dosing system when the first printing process executed previously in the printing press reaches its final phase, wherein the volume of ink remaining in the inking unit on the print substrate side after the disengagement or interruption of the ink feed in the inking unit will continue to be transferred to the print substrate during the final phase of the printing process executed previously in the printing press, for example, for a certain amount of time, specifically, until the ink that remains in the inking unit from the first printing process is at least nearly depleted. A method of this type is known for example, from DE 10 2008 029 998 A1. This printing until the inking unit is empty produces a substantial amount of wasted paper. This procedure is also time-consuming. In addition, the distribution of ink from the first printing process, which extends transversely to the direction of transport of the print substrate, is maintained in principle, and can unfavorably affect a pre-print run of the subsequent, second printing process.

In a third procedure, the pre-print run of the subsequent, second printing process is executed intentionally using the distribution of ink from the first printing process, which extends transversely to the direction of transport of the print substrate. During the pre-print run of the subsequent, second printing process, the dosing from the first printing process of the ink provided in the relevant zones of the ink dosing system, which are arranged transversely to the direction of transport of the print substrate, for example, is adjusted to the dosing that is required for executing the subsequent, second printing process. This procedure leads to difficulties when, in one or more zones, an area coverage for the new, second printing process to be produced in such zones is very low in certain areas or overall as compared with the previous, first printing process. In this case, the excess ink in the relevant zone must be removed entirely during the printing process, i.e., the second printing process. This can take a very long time and can result in a substantial amount of wasted paper.

In some cases, a clean printing of the at least one printing forme disposed on a forme cylinder and of the outer surface of the transfer cylinder that interacts with that forme cylinder is also produced only by disengaging the at least one ink forme roller belonging to the inking unit from the relevant forme cylinder, and by continuing the first printing process only until the ink remaining from the first printing process on the at least one printing forme and/or on the outer surface of the transfer cylinder has been at least nearly depleted. In such cases, the distribution of ink used in the first printing process and extending transversely to the direction of transport of the print substrate is maintained in the inking unit. This can negatively affect a pre-print run of the subsequent, second printing process.

SUMMARY OF THE INVENTION

The problem addressed by the invention is that of devising a method for adjusting an area coverage and a corresponding method for execution in a printing press comprising a plurality of printing couples, in which the changeover of the printing press from a first printing process, currently running in the printing press, to a subsequent, second printing process is optimized.

The problem is solved according to the invention by a method for adjusting an area coverage which is produced using a volume of ink transferred to a print substrate by an inking unit of a printing press. In a final phase of a printing process being carried out by the printing press, an ink feed to the printing unit is either disengaged in zones or is interrupted in the inking unit. A volume of ink remaining on the print substrate side of the printing unit, after the disengagement or interruption of the ink feed in the inking unit in the final phase of the printing process currently being executed in the printing press will continue to be transferred to the print substrate until the area coverage provided with the volume of ink transferred to the print substrate equals a target value for area coverage. A changeover of the printing press, from the printing process currently running in the printing press, to a subsequent printing process, is carried out in a control process that runs automatically. In the subsequent printing process, the same ink is transferred from the inking unit to the print substrate as in the previous printing process. The target value for the area coverage is equal to the area coverage predefined for a pre-print run of the subsequent printing process. The control process is carried out taking into consideration the predefined target value for the area coverage to be adjusted.

The printing press may have a plurality of printing couples in which at least two different inks are applied, by those printing couples, to the same print substrate, along a transport path of the print substrate through the printing press and in order to produce the same printed image. An ink controller calculates how many additional printed images must be imprinted by each of the respective printing couples which are involved in producing these printed images, following an at least zonal disengagement or interruption of an ink feed in each of these printing couples. A volume of ink remains on the print substrate side in each respective printing couple, until an area coverage produced in each of the printing couples with the volume of ink transferred to the print substrate equals a target value for area coverage. The area coverage is provided in each case by a volume of ink which is transferred to the print substrate by an inking unit belonging to the respective printing couple. In the respective printing couple, at least one printing forme, inked by the inking unit for the purpose of executing a previous printing process, is replaced by another printing forme provided for the purpose of executing the subsequent printing process, only after the area coverage produced on the print substrate with the volume of ink remaining in the relevant inking unit equals the target value for area coverage. A changeover of the printing press from the printing process currently running in the printing press, to a subsequent printing process, is carried out in a control process that runs automatically. In the subsequent printing process, the same ink is transferred to the print substrate from each of the inking units involved in executing the previous printing process as in the previous printing process. The respective target value for the area coverage is equal, in each case, to the area coverage predefined for a pre-print run of the subsequent printing process. The control process executed by the ink controller is carried out taking into consideration the respective predefined target value for the area coverage to be adjusted.

The benefits to be achieved by the invention consist particularly in that the printing press can be changed over rapidly and efficiently from a first printing process, currently running in the printing press, to a subsequent, second printing process, because this changeover is carried out in an optimized fashion by the use of an automatic control process, which takes into consideration a predefined target value for the area coverage to be adjusted. The control process minimizes the amount of time required for changing over the printing press and the wasted paper resulting from this changeover. Additionally, the optimization implemented by the control process results in almost no wasted ink. In addition to a savings in material costs, particularly for print substrate and ink, machinery and operating costs can also be reduced, because the printing press is able to enter into regular production in the subsequent, second printing process after only a very short period of time.

BRIEF DESCRIPTION OF THE DRAWINGS

One embodiment example of the invention is illustrated in the set of drawings, and will be specified in greater detail in what follows.

The drawings show.

DESCRIPTION OF THE PREFERRED EMBODIMENT

Figure 1:
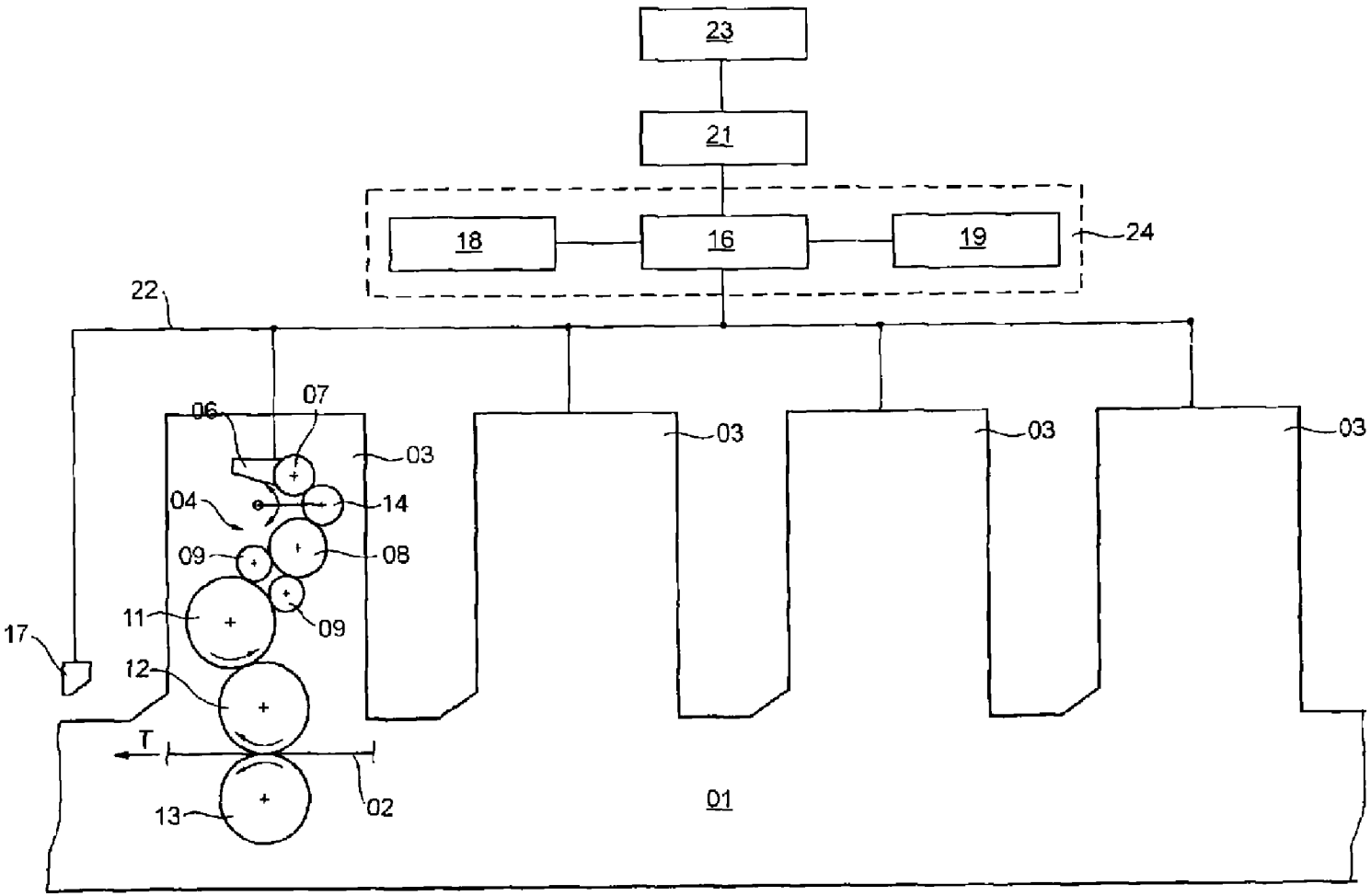
FIG. 1 a printing press comprising a plurality of printing couples, each having an inking unit.

FIG. 1 shows a sectional view of a printing press 01, illustrated only schematically by way of example, in this case a sheet-fed printing press 01 that imprints in an offset printing process and comprises a plurality of printing couples 03, for example, four, arranged in a row in the direction of transport T of a print substrate 02, for example, a sheet of paper 02, wherein each of these printing couples 03 comprises an inking unit 04. Each inking unit 04 has, for example, an ink dosing system comprising an ink fountain 06 and an ink fountain roller 07, for example, and, in a roller train for transporting ink, for example, at least one ink transfer roller 08, optionally a ductor roller 14, and a plurality of ink forme rollers 09, for example, at least two, each of which is engaged with or at least can be engaged with a forme cylinder 11 of the printing couple 03, wherein the forme cylinder 11 rolls against a transfer cylinder 12, at least during a printing process, wherein the transfer cylinder 12 is in turn engaged with an impression cylinder 13, wherein the print substrate 02 passes through a gap that is formed between the transfer cylinder 12 and the impression cylinder 13. The remaining printing couples 03 are similarly configured. In each of the printing couples 03, a different ink can be transferred to the same print substrate 02.

Each ink dosing system, i.e., the dosing elements and/or ink fountain roller 07 thereof, is connected, at least for data transmission purposes, to a control unit 16 via a communications network 22, for example, wherein an ink feed to each inking unit 04 can be adjusted with respect to the quantity of ink to be supplied via the dosing elements and/or the ink fountain roller 07 by the use of at least one control command issued by the control unit 16. In the printing press 01, at least one sensing device 17 is provided, which detects at least one ink density within the printing press 01 during the production of at least one printed image produced on the print substrate 02, and supplies its at least one measured value to the control unit 16, for example, also via the communications network 22. The sensing device 17 is embodied, for example, as an inline-inspection system. The sensing device 17 has at least one camera, for example, more particularly, an electronic, preferably video optical camera, with which the sensing device 17 photographically records a sequence of images of the printed image produced on the print substrate 02. From the recorded image, the control unit 16 is able to determine the ink density of each of the inks involved in producing the relevant printed image, by means of separation, for example. Alternatively, at least one sensing device 17, optimized for a specific ink, for example, can be assigned to each of a plurality of printing couples 03. In that case, each sensing device 17 is disposed at the output of the respective printing couple 03 in the transport direction T of the print substrate 02. The sensing device 17 detects the ink density, for example, in the relevant printed image itself or in an ink measuring strip that is produced on the print substrate 02.

The measured value detected by the sensing device 17 forms an actual value for an area coverage, detectable on the basis of its ink density, for example, of at least one ink transferred to the print substrate 02. The term area coverage refers to a degree of coverage of the print substrate, given as a percentage, for example, by at least one of the inks applied to the print substrate in the printing process. The data on area coverage can be referred to the total area of the printed image or to a partial area thereof, for example, to only a single zone extending through the printed image in the form of a strip. The area coverage is adjusted particularly with respect to a plurality of different partial areas of the same printed image, preferably arranged in parallel strips. For a plurality of these partial areas, particularly for each of these areas, the relevant area coverage is adjusted. The control unit 16 is connected to a memory unit 18, in which at least one target value for the area coverage predefined for the pre-print run of a printing process to follow the printing process currently being executed, and also defined by its ink density, for example, is stored. The respective actual value and the target value for the area coverage each refer to the same total surface area or partial surface area of the relevant printed image.

Particularly when or after a final phase of a printing process executed previously by the printing press 01 is reached, during which final phase a planned production run for a printed product to be produced in the previous printing process has been at least nearly completed and the ink feed to the inking unit 04 is disengaged or interrupted in the inking unit 04 by the control unit 16, the control unit 16 compares the currently detected actual value, provided by the sensing device 17, with the target value for the area coverage, particularly the ink density, valid for the relevant ink, which is stored in a memory unit 18. The ink feed to the inking unit 04 is disengaged by an automatically executed actuation of the ink dosing system, for example. This actuation closes at least one dosing element of the ink dosing system. The actuated dosing element is active in at least one of a plurality of ink zones arranged side by side in a row, transversely to the direction of transport T of the print substrate 02, for example. Alternatively or additionally, the ink feed in the respective inking unit 04 can be interrupted by disengaging a ductor roller 14.

A computer unit 19 is also connected to the control unit 16. The computer unit 19 uses at least the comparison, carried out by the control unit 16, of the actual value for the detected ink density with the target value thereof, predefined for the pre-print run of the subsequent printing process, to calculate a number of sheets of the sheet-type print substrate, assuming the print substrate 02 is embodied as sheet-type, and where this number of sheets indicates how many additional sheets must be imprinted with the volume of ink remaining in the inking unit 04 until the area coverage equals the target value for area coverage predefined for the pre-print run of the subsequent printing process. The control unit 16, the memory unit 18, and the computer unit 19 can be embodied in the same component, as is indicated in FIG. 1 by a dashed perimeter line. This component can be designated as an ink controller 24. This component, or at least individual elements thereof, can be embodied as being connected for purposes of data transmission to a control panel 21 belonging to the printing press 01, i.e., a superordinate control unit, or as integrated into the control panel 21.

Accordingly, a method for adjusting an area coverage can be executed in the printing press 01, in which the area coverage, which can be detected, for example, on the basis of its ink density or also its ink layer thickness, is produced by a volume of ink transferred to a print substrate 02 by an inking unit 04 of the printing press 01. When a final phase of a printing process, executed up to that time by the printing press 01, is reached, an ink feed to the inking unit 04 is disengaged at least partially, i.e., in zones, or is interrupted in the inking unit 04. During the final phase of the printing process executed previously in the printing press 01, the volume of ink remaining on the print substrate side, after the disengagement or after the interruption of the ink feed in the inking unit 04, will continue to be transferred to the print substrate 02 until the area coverage produced by the volume of ink transferred to the print substrate 02 equals a target value for area coverage, predefined for a pre-print run of a subsequent printing process, which area coverage is also defined on the basis of its ink density or ink layer thickness, for example. In this case, a printing forme in the printing press 01 for executing the previous printing process, and inked by the inking unit 04, is preferably replaced by another printing forme, provided for executing the subsequent printing process, only after the area coverage produced on the print substrate 02 with the volume of ink remaining in the inking unit 04 equals the target value for area coverage predefined for the pre-print run of the subsequent printing process. This method is carried out particularly with the prerequisite that in the subsequent printing process, the same ink will be transferred by the inking unit 04 to the print substrate 02 as in the previous printing process.

The method can also be carried out in, or with the same ink controller 24, for example, in a printing press 01 comprising a plurality of printing couples 03. Each of these printing couples 03 is assigned its own inking unit 04. At least in two of these printing couples 03, different inks are transferred to the same print substrate 02, transported through the printing press 01, for the purpose of producing the same printed image. The computer unit 19 then calculates, for each of the plurality of printing couples 03, the number of sheets of the sheet-type print substrate 02 or the number of printed images, which in each case indicates how many additional sheets or how many additional printed images must be printed using the volume of ink remaining in the respective inking unit 04 until the area coverage produced in connection with the respective inking unit 04 equals the target value for the area coverage to be produced in connection with the respective inking unit 04 for the pre-print run of the subsequent printing process. The calculated number of sheets or printed images can be displayed on a display device 23 belonging, for example, to the control panel 21. In each inking unit 04, for example, the at least one ink forme roller 09 thereof is disengaged from the printing forme that is inked in the relevant printing couple 03, as soon as the number of sheets or printed images, calculated by the computer unit 19, and required in order for the area coverage produced in connection with the respective inking unit 04 to equal the target value for the area coverage to be produced in connection with the respective inking unit 04 for the pre-print run of the subsequent printing process, has been imprinted in the relevant printing couple 03.

More particularly, when the same ink controller 24 carries out the specified method for adjusting an area coverage in a printing press 01 comprising a plurality of printing couples 03, the control panel 21 is to supply information to the ink controller, for example, regarding the inking unit assignment of the inking units 04 used in the printing press 01, with respect to the pre-print run of the subsequent printing process, before that process is executed. In addition, with respect to the pre-print run of the subsequent printing process, the specific target values for the each zonal area coverage, for example, in the form of the respective target ink density, are stored in the memory unit 18 for each inking unit 04 to be used, for example. These target values can be stored, for example, in connection with, or on the basis of the type of print substrate 02 to be used, for example, the paper class. Using a difference between currently detected actual values and stored target values, and taking into consideration a rotational velocity of the respective ink fountain roller 07 and/or at least a time constant for building up and/or reducing an ink layer thickness in the respective inking unit 04 or printing couple 03, for example, the computer unit 19 then calculates, preferably for each of the plurality of printing couples 03, the respective number of printed images or the number of sheets of the sheet-type print substrate 02 that indicates how many additional printed images or sheets must be imprinted using the volume of the respective ink remaining in the particular inking unit 04, without over-inking the print substrate 02, in carrying out the pre-print run of the subsequent printing process. The inking zone that will require the longest to reduce an ink surplus that is present in the inking unit 04 or printing couple 03 during the printing process currently being carried out in relation to the new, subsequent printing process will determine the number of printed images or sheets that should continue to be printed in the printing process currently being executed. For inking zones in which the area coverage and therefore the ink laydown is higher for the new, subsequent printing process than for the previous printing process, ink can even be supplied to a limited degree during the pre-print run of the subsequent printing process, by the use of a control command sent by the ink controller 24 to the relevant inking unit 04 and/or ink dosing system, as a result of which, to allow the relevant inking unit 04 or printing couple 03 to print until empty, the ink feed is not completely blocked by disengaging the ductor roller 14, for example, and instead, only the remaining inking zones not affected by this exception are closed.

Therefore, the discovered method, which is provided for execution in a printing press 01 that comprises a plurality of printing couples 03, can also be formulated such that at least two different inks are applied by these printing couples 03 to the same print substrate 02 along the transport path thereof through the printing press 01 in order to produce the same printed image. Preferably the same ink controller 24 calculates, on the basis of at least one detected actual value for area coverage, precisely how many additional printed images must be printed by the respective printing couples 03 involved in producing those printed images, using a volume of ink remaining on the print substrate side in the respective printing couple 03, following an at least zonal disengagement or interruption of an ink feed in each of the printing couples 03, until the area coverage produced with the volume of ink transferred to the print substrate 02 in the respective printing couples 03 equals a target value for area coverage predefined for a pre-print run of a subsequent printing process.

Figure 2:
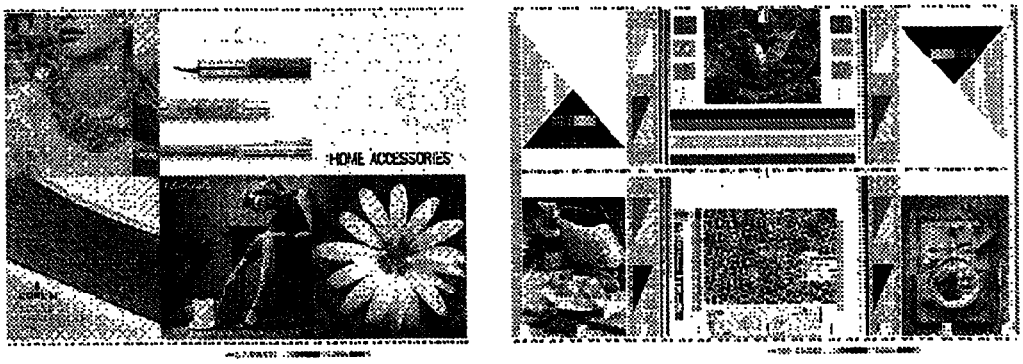
FIG. 2 a changeover in print jobs.

As was described above, the computer unit 19 of the ink controller 24 calculates, for example, the number of sheets or printed images required for the pending change in print job, and preferably also an ink zone profile to be used in the relevant inking unit 04. This procedure will now be specified in detail using the example of a sheet-fed printing press for two different inks, in reference to FIGS. 2 to 14, wherein a left column contains data for a printing process currently being executed (job A), and a right column contains corresponding data for a new, subsequent printing process (job B). For instance, FIG. 2 illustrates the initial situation, and in comparison with this, the new situation to be implemented. FIGS. 3 to 14 contain graphs illustrating various intermediate steps, and ultimately the results of the calculations performed by the computer unit 19.

Figure 3:
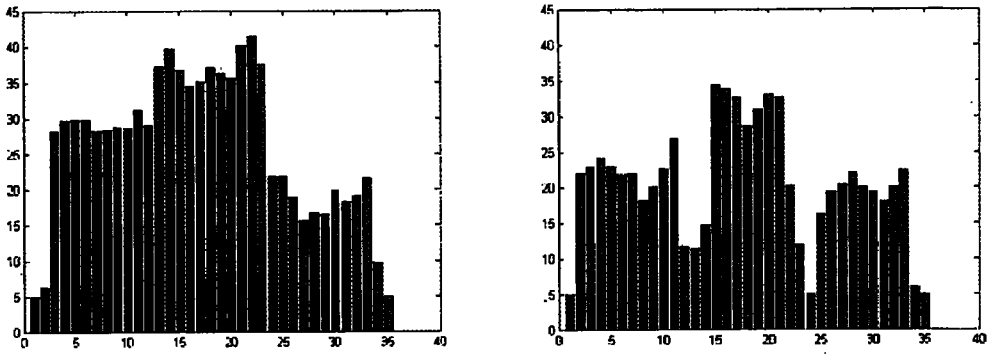
FIG. 3 to 14 diagrams showing various intermediate steps, and the results of a calculation performed by a computer unit, in each case for two examples of different inks.

According to FIG. 3, for each of the aforementioned jobs A and B a weighted sliding average of the two area coverage profiles $FD_A$ and $FD_B$ has been generated, in this case specifically for cyan ink, for example.

Figure 4:
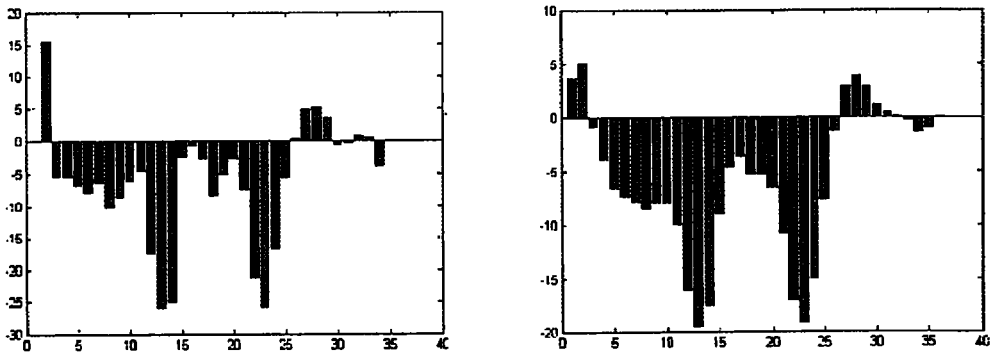
Figure 5:
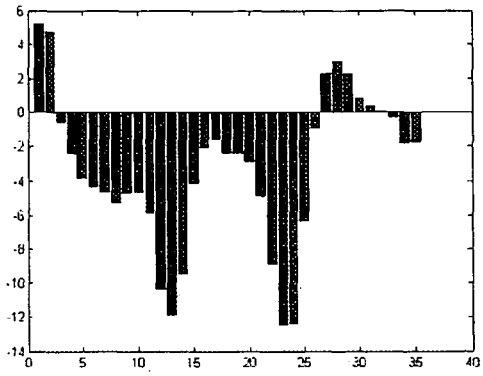

In FIG. 4, a difference in the ink zone openings $FZ_{Diff}$ for $FD_A$ and $FD_B$ has been determined, at a specific velocity of the ink fountain roller 07 of job A from a characteristic curve family FZ/ink fountain roller. $FZ_{Diff}$ is signed. FIG. 5 illustrates the difference in the stationary ink zone openings.

Figure 6:
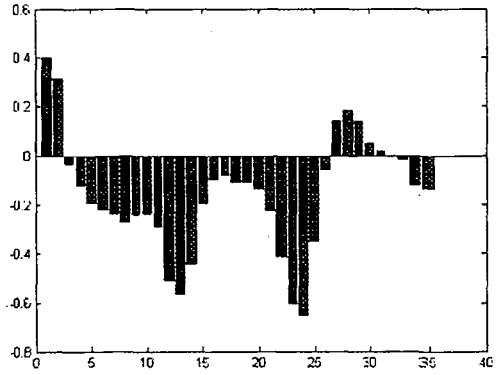
Figure 7:
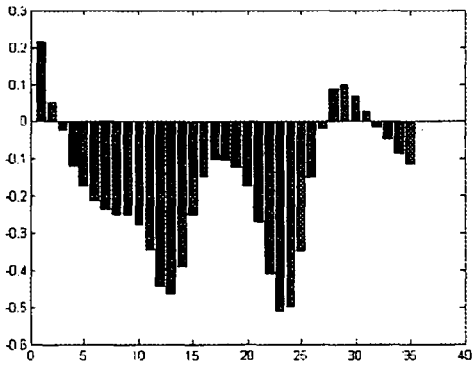

According to FIG. 6, an equivalent density difference $D_{Diff}$ has been calculated by multiplying the ink zone opening difference $FZ_{Diff}$ by an increase $V_A$ for the area coverages for job A. The density difference must be limited to logical values for increasing ink zones, for example, 0.4D, in order to prevent ink build-up. It may be necessary to expand the density difference to include ink zones that have been printed empty, i.e., for ink zones in which the density difference is negative (FIG. 7): $D_{Diff}=FZ_{Diff}*V_A$.

Figure 8:
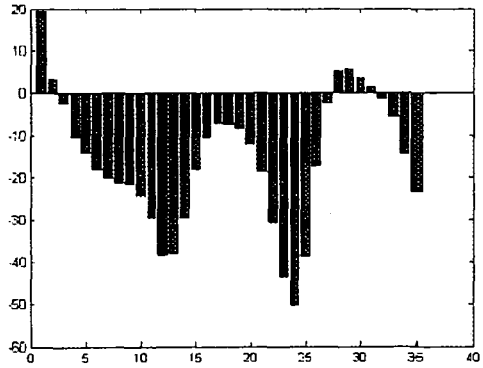
Figure 9:
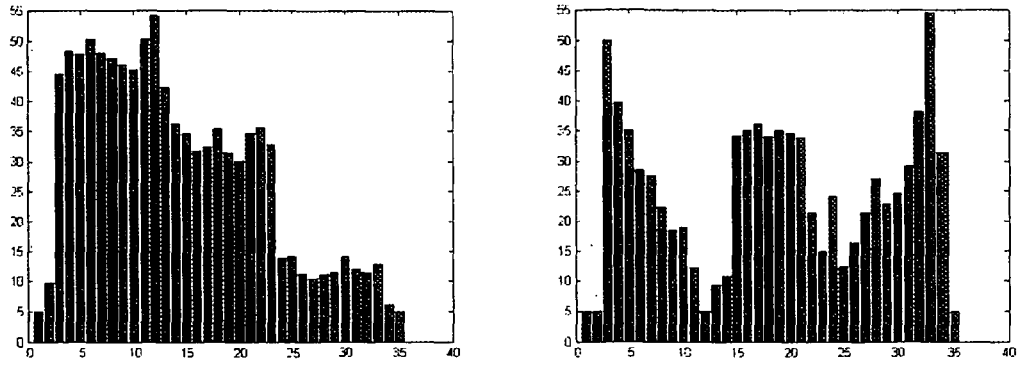
Figure 10:
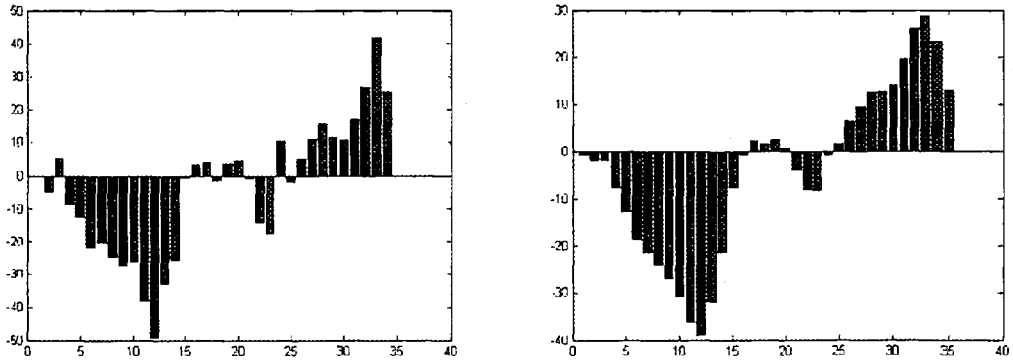
Figure 11:
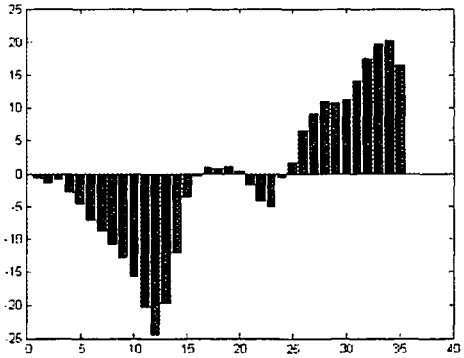
Figure 12:
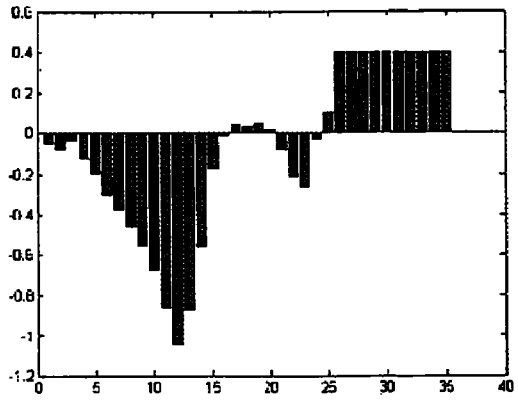
Figure 13:
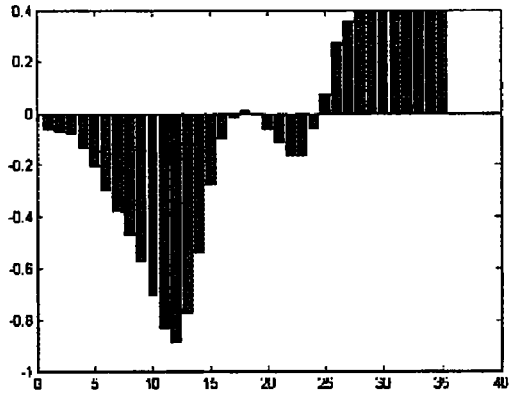
Figure 14:
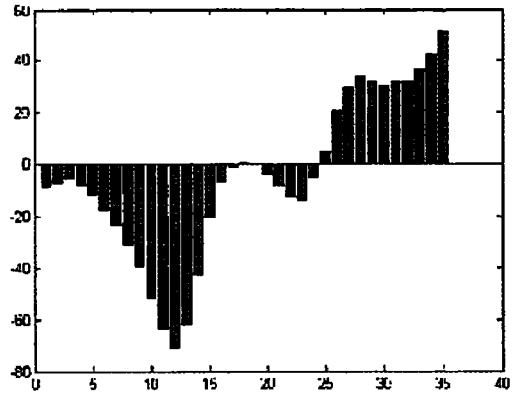

In FIG. 8, the time constants $PT1_{up}$ and $PT1_{dwn}$ have been used to determine an increase or decrease, respectively, and a density difference $D_{Diff}$ has been used to determine the number of additional sheets $BZ_x$ that must be printed: $BZ_x=-T_x*\ln(1-D_{Diff}/D_A)$, in which $D_A$=target density of job A and $T_x$=the time constant for the relevant inking zone. The minimum of $BZ_x$ is the number of additional sheets $BZ_x$ that must be printed. In the illustrated example, approximately 50 additional sheets must be printed with cyan ink, or in the case of multicolor printing, with the cyan ink segment, before the subsequent printing process (job B) reaches regular production.

An initial ink zone opening profile is then calculated for the subsequent printing process (job B), which profile will be used by the ink dosing system relating in this example to the cyan ink. For this purpose, the last density values are converted to stationary ink zone openings prior to completion of the controlled emptying by printing, taking into consideration area coverages $FD_B$, the velocity $DS_B$ of the ink fountain roller 07 and the ductor timing $HT_B$.

FIGS. 9 to 14 illustrate a second example of another ink, for example, yellow, wherein FIGS. 9 to 14 correspond to FIGS. 3 to 8, respectively. The preceding statements relating to cyan ink apply here similarly. According to the example illustrated in FIGS. 9 to 14 for the yellow ink or, in the case of multicolor printing, for the yellow color segment, approximately 71 additional sheets must be imprinted from job A before job B transitions into regular production.

As the two illustrated examples show, regular production of the subsequent printing process (job B) is reached following a number of sheets or printed images, which is calculated precisely by means of a program. At precisely this number of successive sheets or printed images, the changeover from the first printing process (job A), being executed in the printing press, to the subsequent, second printing process (job B) is achieved in an optimized manner. Therefore, with the proposed ink controller 24, the changeover of the printing press from a first printing process, currently running in the printing press, to a subsequent, second printing process is optimized on the basis of a precisely calculated number of sheets or printed images.

While a preferred embodiment of a method for adjusting an area coverage, and a corresponding method for execution in a printing press having a plurality of printing couples in accordance with the present invention has been set forth fully and completely hereinabove, it will be apparent to one of skill in the art that various changes to, for example, the specific structures of the inking units, printing couples, and printing presses could be made without departing from the true spirit and scope of the present invention which is accordingly to be limited only by the appended claims.

What is claimed is:

1. A method for adjusting an area ink coverage, produced using a volume of an ink transferred to a print substrate by an inking unit of a printing press and having at least one ink forme roller including:

reaching a final phase of a first printing process carried out by the printing press;

at least one of disengaging and interrupting an ink feed to the inking unit in at least one of several zones in the inking unit;

selecting a target value for the area ink coverage as being equal to an area ink coverage for the same ink and predefined for a pre-print run of a second printing process;

continuing to transfer a volume of ink remaining on the print substrate side of the inking unit after the one of disengagement and interruption of the ink feed in the inking unit in the final phase of the first printing process being executed in the printing press until the area ink coverage produced with the volume of ink transferred to the print substrate (02) equals the target value for the area ink coverage;

providing an automatically running control process;

changing over the printing press from the first printing process running in said printing press to the second printing process using the control process that runs automatically;

transferring the same ink from the inking unit to the print substrate in the second printing process as in the first printing process; and carrying out the changing over of the printing process using the control process and reaching the predefined target value for the area ink coverage predefined for the pre-print run of the second printing process.

2. The method according to claim 1 further including providing a first printing forme, inked by the inking unit in the printing press for the purpose of executing the first printing process, and replacing the first printing forme by another printing forme which is provided for the purpose of executing the second printing process only after the area ink coverage produced on the print substrate with the volume of ink remaining in the inking unit equals the target value for area ink coverage predefined for the pre-print run of the second printing process.

3. The method according to claim 1 further including providing a control unit and using the control unit for comparing the area ink coverage detected during the pre-print run of the second printing process as an actual value with a target value for the area coverage predefined for said pre-print run, which target valve is stored in a memory unit.

4. The method according to claim 3, further including providing a computer unit and using the computer unit for making at least the comparison, carried out by the control unit, of the actual value for the detected area coverage with the target value thereof, predefined for the pre-print run of the second printing process, and calculating a number of sheets of the print substrate, with this number of sheets indicating how many additional sheets must be printed with the volume of ink remaining in the inking unit until the area ink coverage equals the target value for area coverage predefined for the pre-print run of the second printing process.

5. The method according to claim 4 further including calculating one of the number of sheets and a number of printed images, taking into consideration at least one of a rotational velocity of an ink fountain roller belonging to the respective inking unit and at least one time constant for at least one of building up and reducing an ink layer thickness in one of the respective inking unit and the printing couple.

6. The method according to claim 4 further including providing a display device and displaying the calculated one of number of sheets and printed images on the display device.

7. The method according to claim 1 further including providing the printing press having a plurality of printing couples each having at least one printing forme with each printing couple being assigned its own inking unit and using at least two of these printing couples for transferring different inks to the same print substrate being transported through the printing press.

8. The method according to claim 7 further including using a computer unit and calculating, for each of the plurality of the printing couples a specific number of sheets of the print substrate and indicating how many additional sheets must be printed with the volume of the particular ink remaining in the respective inking unit until the area coverage produced in connection with the respective inking unit equals the target value, predefined for the pre-print run of the second print process, for the area coverage to be produced in connection with each respective inking unit.

9. The method according to claim 7 further including disengaging, in the respective inking unit, the at least one ink forme roller thereof from the printing forme inked in the relevant printing couple as soon as a number of sheets, that are required before the area coverage produced in connection with the respective inking unit equals the target value for the area coverage to be produced in connection with the respective inking unit, and predefined for the pre-print run of the subsequent printing process, have been imprinted in the relevant printing couple.

10. The method according to claim 1, further including transferring the ink in the printing press to one of a sheet-type and a web-type print substrate.

11. The method according to claim 1, further including adjusting the area ink coverage with respect to one a total area of the printed image and with respect to a partial area thereof.

12. The method according to claim 1 further including adjusting the area ink coverage with respect to a plurality of different partial areas of the same printed image, and wherein, for each of a plurality of these partial areas, the associated area coverage is adjusted.

13. The method according to claim 1 further including adjusting the area ink coverage in each case by an ink dosing system having a plurality of dosing elements that act in zones, and wherein a plurality of ink zones are arranged side by side, transversely to a transport direction of the print substrate that is transported through the printing press.

14. The method according to claim 1 further including disengaging the ink feed to the inking unit at least in zones by actuating an ink dosing system, and wherein at least one dosing element of the ink dosing system is closed by this actuation.

15. The method according to claim 14 further including actuating the ink dosing system and closing the dosing element, which is active in at least one ink zone, of the ink dosing system, which ink dosing system comprises a plurality of ink zones arranged in a row transversely to a direction of transport of the print substrate.

16. The method according to claim 1 further including interrupting the ink feed in one of the inking unit and in the respective inking unit in each case by disengaging a ductor roller.

17. The method according to claim 1 further including producing an ink measuring strip on the print substrate in the pre-print run of the second printing process.

18. The method according to claim 1 further including detecting at least during the pre-print run of the second printing process, an ink density of the area coverage produced on the print substrate.

19. The method according to claim 18 further including detecting the ink density within the printing press by using at least one sensing device.

20. The method according to claim 18 further including detecting the ink density by using an inline inspection system.

21. A method for adjusting an area ink coverage and usable for execution in a printing press comprising a plurality of printing couples including:

using the plurality of printing couples and applying at least two different inks to a print substrate being transported along a transport path thereof through the printing press for producing a printed image on the print substrate;

providing an ink controller and using the ink controller for calculating how many additional printed images must be imprinted by each of the respective printing couples involved in producing these printed images, following at least one of a zonal disengagement and an interruption of an ink feed in each of these printing couples until a volume of ink remaining on a print substrate side in each respective printing couple and forming an area ink coverage produced in each of the printing couples, using the volume of ink transferred to the print substrate, equals a target value for an area ink coverage;

producing the area coverage, in each case, by transferring a volume of ink to the print substrate by an inking unit belonging to the respective printing couple;

replacing, in the respective printing couple, at least one printing forme, inked by the inking unit for the purpose of executing a first printing process, by another printing forme provided for the purpose of executing a second printing process only after the area ink coverage produced on the print substrate with the volume of ink remaining in the relevant inking unit equals the target value for area ink coverage;

carrying out a changeover of the printing press from the first printing process currently running in said printing press to the second printing process in a control process that runs automatically;

transferring ink to the print substrate in the second printing process from each of the inking units involved in executing the second printing process as in the first printing process;

defining a respective target value for the area ink coverage being equal in each case to the area ink coverage predefined for a pre-print run of the second printing process; and carrying out the changing over of the printing press using the control process executed by the ink controller and reaching the respective predefined target value for the area ink coverage predefined for the pre-print run of the second printing process.

* * * * *

UNITED STATES PATENT AND TRADEMARK OFFICE

CERTIFICATE OF CORRECTION

PATENT NO. : 8,230,787 B2
APPLICATION NO. : 13/138444
DATED : July 31, 2012
INVENTOR(S) : Steven Flemming It is certified that error appears in the above-identified patent and that said Letters Patent is hereby corrected as shown below:

Column 10, in claim 1, line 61, after "substrate", delete "(02)"; and

Column 12, in claim 11, line 9, after "one", insert --of--.

Signed and Sealed this
Twenty-third Day of October, 2012

David J. Kappos

David J. Kappos
*Director of the United States Patent and Trademark Office*